US009904194B2

(12) United States Patent
Kimpara et al.

(10) Patent No.: US 9,904,194 B2
(45) **Date of Patent: *Feb. 27, 2018**

(54) ELECTROSTATIC LATENT IMAGE DEVELOPING TONER

(71) Applicant: Konica Minolta, Inc., Tokyo (JP)

(72) Inventors: Noriyuki Kimpara, Toyohashi (JP); Satoshi Uchino, Hino (JP); Shinya Obara, Fuchu (JP); Futoshi Kadonome, Sagamihara (JP); Ikuko Sakurada, Hachioji (JP); Takuya Takahashi, Higashimurayama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/282,177

(22) Filed: Sep. 30, 2016

(65) Prior Publication Data

US 2017/0123334 A1 May 4, 2017

(30) Foreign Application Priority Data

Oct. 29, 2015 (JP) ..... 2015-212492

(51) Int. Cl.
*G03G 9/08* (2006.01)
*G03G 9/087* (2006.01)
*G03G 9/097* (2006.01)

(52) U.S. Cl.
CPC ..... *G03G 9/08755* (2013.01); *G03G 9/0819* (2013.01); *G03G 9/08788* (2013.01); *G03G 9/08797* (2013.01); *G03G 9/09791* (2013.01)

(58) Field of Classification Search
CPC ..... G03G 9/08755; G03G 9/08788; G03G 9/08791; G03G 9/08797
USPC ..... 430/109.4
See application file for complete search history.

(56) References Cited

U.S. PATENT DOCUMENTS

2003/0198886 A1 10/2003 Chen et al.
2014/0370427 A1 12/2014 Sasaki et al.

FOREIGN PATENT DOCUMENTS

JP 07-092736 A 4/1995
JP 11-323396 A 11/1999
JP 2003-058009 A 2/2003
JP 2006251564 A 9/2006
JP 2010-009044 A 1/2010
JP 2010-102057 A 5/2010
JP 2010128216 A 6/2010
JP 2010-160367 A 7/2010
JP 2010-185999 A 8/2010
JP 2010186165 A 8/2010
JP 2011-034079 A 2/2011
JP 2011-064768 A 3/2011
JP 2012-177915 A 9/2012
JP 2013-117564 A 6/2013
JP 2014-228654 A 12/2014
JP 2014-235394 A 12/2014
JP 2015-004869 A 1/2015

OTHER PUBLICATIONS

Office Action dated May 26, 2017 from corresponding U.S. Appl. No. 15/274,304.
Translation of JP 2010-102057 published May 2010.
Translation of JP 2013-117564 published Jun. 2013.
Translation of the abstract of 2015-004869 published Jan. 2015.
Product data sheet for Aerosil RX50, Oct. 2016; https://www.aerosil.com/www2/uploads/productfinder/AEROSIL-RX-50-EN.pdf.
Office Action dated Sep. 21, 2017 from corresponding U.S. Appl. No. 15/274,304.
Notice of Reasons for Rejection dated Nov. 8, 2016 from Japanese Application No. JP 2015-215662 and English translation.
Notice of Reasons for Rejection dated Oct. 17, 2017 from the corresponding Japanese Application No. JP 2015-212492 and Machine English translation.

*Primary Examiner* — Mark A Chapman
(74) *Attorney, Agent, or Firm* — Lucas & Mercanti, LLP

(57) ABSTRACT

An electrostatic latent image developing toner of the present invention includes toner base particles and particles containing a fatty acid metal salt. The toner base particles contain a crystalline resin containing a segment of a first resin and a segment of a second resin chemically bonded to each other and an amorphous resin containing at least the second resin. The crystalline resin is a hybrid crystalline polyester resin. The first resin is a crystalline polyester resin. The second resin is an amorphous resin. The volume-based median diameter (Da) of the toner base particles and the volume-based median diameter (Db) of the particles containing the fatty acid metal salt satisfy the relations represented by Expressions (1) and (2) below:

$0.5\ \mu m \leq Db \leq 2.0\ \mu m$ Expression (1)

$0.1\ Db/Da \leq 0.5.$ Expression (2)

5 Claims, No Drawings

ELECTROSTATIC LATENT IMAGE DEVELOPING TONER

This application is based on Japanese Patent Application No. 2015-212492 filed on Oct. 29, 2015 with Japan Patent Office, the entire content of which is hereby incorporated by reference.

1. FIELD OF THE INVENTION

The present invention relates to an electrostatic latent image developing toner. More specifically, the present invention relates to an electrostatic latent image developing toner having low-temperature fixability which is excellent in document offset property and capable of forming high-quality images.

2. DESCRIPTION OF RELATED ART

Presently, toners having low-temperature fixability have been developed in view of energy saving and high printing rate. Toners having low-temperature fixability can be realized by reducing glass transition temperature (also referred to as "Tg", hereinafter) of a binder resin, by introducing a crystalline resin to an amorphous resin for obtaining a binder resin having a sharp-melting property, and the like. However, low Tg of a binder resin reduces heat-resistance of output images and causes the problems of document offset, such as adhesion of discharged and loaded papers. The introduction of a crystalline resin to an amorphous resin leads to compatibility between the crystalline resin and the amorphous resin. The resulting low Tg of the binder resin also results in low heat-resistance of output images and causes the problems of document offset.

JPA 2010-186165 discloses a technique of introducing a release agent having a specified structure in order to suppress document offset. However, it is difficult to provide enough effect by this technique when a toner contains a crystalline resin for the purpose of improving further low-temperature fixability. Thus, further improvement has been desired.

SUMMARY OF THE INVENTION

An object of the present invention, which has been made in view of the above-described problems and circumstances, is to provide an electrostatic latent image-developing toner having low-temperature fixability which is excellent in document offset property and capable of forming high-quality images.

The present inventors have found the following and have arrived at the present invention. By using a hybrid crystalline polyester resin composed of a crystalline resin partly binding to an amorphous resin and by adding particles containing a fatty acid metal salt and having a small diameter, crystallization of the crystalline resin during fixation can be promoted and the generation of document offset due to the compatibility between the crystalline resin and the amorphous resin can be inhibited.

The object of the present invention can be achieved by the following aspects:

1. An electrostatic latent image developing toner containing toner base particles and particles containing a fatty acid metal salt, wherein the toner base particles contains a crystalline resin containing a segment of a first resin and a segment of a second resin chemically bonded to each other and an amorphous resin containing at least the second resin;

the crystalline resin is a hybrid crystalline polyester resin;

the first resin is a crystalline polyester resin;

the second resin is an amorphous resin; and the volume-based median diameter (Da) of the toner base particles and the volume-based median diameter (Db) of the particles containing the fatty acid metal salt satisfy the relations represented by Expressions (1) and (2) below:

$$0.5\ \mu m \leq Db \leq 2.0\ \mu m \qquad \text{Expression (1)}$$

$$0.1\ Db/Da \leq 0.5. \qquad \text{Expression (2)}$$

2. The electrostatic latent image developing toner according to item 1, wherein a content of the segment of the second resin is in a range of 0.1% to 30% by mass based on an amount of the hybrid crystalline polyester resin.

3. The electrostatic latent image developing toner according to item 1, wherein a content of the hybrid crystalline polyester resin is in a range of 5% to 30% by mass based on an amount of the toner base particles.

4. The electrostatic latent image developing toner according to item 1, wherein the second resin is a vinyl resin.

5. The electrostatic latent image developing toner according to item 1, wherein the volume-based median diameter (Da) of the toner base particles satisfies the relation represented by Expression (3) below:

$$3.5\ \mu m \leq Da \leq 9.0\ \mu m. \qquad \text{Expression (3)}$$

DESCRIPTION OF EMBODIMENTS

An electrostatic latent image developing toner according to the present invention contains toner base particles and particles containing a fatty acid metal salt, the toner base particles contain a crystalline resin containing a segment of a first resin and a segment of a second resin chemically bonded to each other and an amorphous resin containing at least the second resin; the crystalline resin is a hybrid crystalline polyester resin; the first resin is a crystalline polyester resin; the second resin is an amorphous resin; and the volume-based median diameter (Da) of the toner base particles and the volume-based median diameter (Db) of the particles containing the fatty acid metal salt satisfy the relations represented by Expressions (1) and (2) above. These technical features are common to or correspond to the inventions according to each item.

The mechanism of development and operation on the effects of the present invention is not clear, but can be presumed as follows.

A crystalline resin is compatible with an amorphous resin and reduces the glass transition temperature (also referred to as "Tg", hereinafter) of a binder resin. For suppressing reduction of Tg, it is important to improve crystallization during fixation. The crystalline resin of the present invention is a hybrid crystalline polyester resin containing a segment of a first resin (a polyester structure) and the amorphous resin of the present invention contains a segment of a second resin (a structure other than a polyester structure). According to the structures, a non-compatible state is formed easily during fixation. If a part of the crystalline polyester resin is bonded to the segment of the second resin (the structure other than the polyester structure) in the hybrid crystalline resin, the crystalline resin is aligned to the segment of the second resin (the structure other than the polyester structure). The crystallization of the resin is presumed to be promoted when the crystalline molecules are thus aligned, rather than when they are randomly arranged.

Meanwhile, particles containing a fatty acid metal salt are added to the toner as an external additive, for the purpose of improving cleanability. In the process of forming an electrophotographic image, the particles containing the fatty acid metal salt having a diameter smaller than the toner particle diameter move with the toner and form a fixed image. The particles containing the fatty acid metal salt have low molecular weight than resin and distribute at the surface of the image. Therefore, a coating is considered to be formed on the surface of the fixed image.

Furthermore, particles containing a fatty acid metal salt function as nuclei for crystalline growth during fixation. As a result, the crystallization of the crystalline resin is presumed to be further promoted.

When the volume-based median diameter (Db) of the particles containing the fatty acid metal salt is more than 0.5 times of the volume-based median diameter (Da) of the toner base particle, the particles containing the fatty acid metal salt cannot be fixed to the toner base particle. As a result of separation of the particles containing the fatty acid metal salt from the toner base particles before fixed image is formed, it is presumed that a coating cannot be formed on the surface of the fixed image and the crystallization of the crystalline resin cannot be promoted.

When the volume-based median diameter (Db) of the particles containing the fatty acid metal salt is smaller than 0.1 times of the volume-based median diameter (Da) of the toner base particle, the volume of the particles containing the fatty acid metal salt is presumed to be too small for providing enough effect as a coating on the fixed image.

As described above, in the embodiment of the present invention, the alignment of the crystalline resin is improved by elaborating the resin composition contained in the toner base particle. The particles containing the fatty acid metal salt having a small diameter and used as an external additive function as nuclei in crystalline growth. It is presumed that the reduction of Tg of the resin can suppressed by promoting the crystallization of the crystalline resin from inside and surface of the resin composing the image, and that the document offset resistance can be improved by coating the surface of the image with the particles containing the fatty acid metal salt.

A preferable embodiment of the present invention is characterized in that the content of the segment of the second resin is in a range of 0.1% to 30% by mass based on the amount of the hybrid crystalline polyester resin, from the viewpoint of promoting crystallization.

In the present invention, it is preferred that the content of the hybrid crystalline polyester resin in the toner base particles is in a range of 5% to 30% by mass based on the amount of the toner base particle, from the viewpoint of preventing insufficient crystalline growth during fixation.

In the present invention, it is preferred that the second resin is a vinyl resin, from the viewpoint of further suppression of compatibility with the first resin.

In the present invention, it is preferred that the volume-based median diameter (Da) of the toner base particles satisfies the relation represented by Expression (3) above, from the viewpoint of obtaining the effect of the present invention more preferably.

The present invention and the constitution elements thereof, as well as configurations and embodiments, will be detailed in the following. In the present description, when two figures are used to indicate a range of value before and after "to", these figures themselves are included in the range as a lowest limit value and an upper limit value.

<<Summary of an Electrostatic Latent Image Developing Toner>

The electrostatic latent image developing toner according to the present invention is characterized in having the following feature. The toner contains toner base particles and particles containing a fatty acid metal salt. The toner base particles contain a crystalline resin containing a segment of a first resin and a segment of a second resin chemically bonded to each other and an amorphous resin containing at least the second resin. The crystalline resin is a hybrid crystalline polyester resin; the first resin is a crystalline polyester resin; the second resin is an amorphous resin; and the volume-based median diameter (Da) of the toner base particles and the volume-based median diameter (Db) of the particles containing the fatty acid metal salt satisfy the relations represented by Expressions (1) and (2) below:

$$0.5\ \mu m \leq Db \leq 2.0\ \mu m \quad \text{Expression (1)}$$

$$0.1\ Db/Da \leq 0.5. \quad \text{Expression (2)}$$

[Electrostatic Latent Image Developing Toner]

An electrostatic image developing toner (also simply referred to as "toner", hereinafter) according to the present invention contains at least toner base particles and particles containing a fatty acid metal salt.

An aggregate of "toner particles" are referred to as a "toner" in the present invention.

<<Toner Base Particles>>

The toner base particles according to the present invention contains a crystalline resin containing a segment of a first resin and a segment of a second resin chemically bonded to each other and an amorphous resin containing at least the second resin. The toner base particles to which particles containing a fatty acid metal salt are added as an external additive are referred to as toner particles in the present invention.

The toner base particles according to the present invention can be manufactured by any known process. Examples of the process include kneading pulverization, suspension polymerization, emulsion aggregation, dissolution suspension, polyester stretching, and dispersion polymerization. Among these processes, preferred is a build-up type process (e.g. emulsion associated polymerization, rather than suspension polymerization) and dissolution suspension from the viewpoint of reducing the toner diameter and controlling circularity.

[Binder Resin]

The binder resin of the toner base particles according to the present invention contains a crystalline resin and an amorphous resin. The crystalline resin is composed of a segment of a first resin and a segment of a second resin chemically bonded to each other. The amorphous resin contains at least the second resin.

[Amorphous Resin]

The amorphous resin according to the present invention is a resin containing the second resin. The amorphous resin is a resin that does not exhibit a melting temperature and has relatively high glass transition temperature (Tg) when measured with differential scanning calorimetry (DSC).

The above-described amorphous resin has $Tg_1$ (glass transition temperature measured with DSC at a first temperature increasing step) preferably in the range of 35 to 80° C., and more preferably in the range of 45 to 65° C. The above-described amorphous resin has $Tg_2$ (glass transition temperature measured with DSC at a second temperature increasing step) preferably in the range of 20 to 70° C., and more preferably in the range of 30 to 55° C.

The toner according to the present invention can contain an amorphous resin other than the second resin as long as it does not reduce the effect of the present invention.

<Second Resin>

The second resin is an amorphous resin. The second resin is the same kind of resin as the amorphous resin included in the hybrid crystalline polyester resin described later.

Here, "the same kind of resin" indicates the resin in which a characteristic chemical bond is commonly included in the repeating unit. The meaning of "the characteristic chemical bond" is determined by "polymer classification" indicated in a database provided by National Institute for Material Science (NIMS): (http://polymer.nims.go.jp/PoLyInfo/guide/jp/term_polymer.html). Namely, the chemical bonds which constitute the following 22 kinds of polymers are called as "the characteristic chemical bonds": polyacryls, polyamides, polyacid anhydrides, polycarbonates, polydienes, polyesters, poly-halo-olefins, polyimides, polyimines, polyketones, polyolefins, polyethers, polyphenylenes, polyphosphazenes, polysiloxanes, polystyrenes, polysulfides, polysulfones, polyurethanes, polyureas, polyvinyls and other polymers.

"The same kind of resins" for the copolymer resins indicates resins having a common characteristic chemical bond in the chemical structure of a plurality of monomers which constitute the copolymer, when the copolymer has the monomers including the above-described chemical bonds as constituting units. Consequently, even if the resins each have a different property with each other, and even if the resins each have a different molar ratio of the monomers which constitute the copolymers, the resins are considered to be the same kind of resins as long as they contain a common characteristic chemical bond.

For example, the resin (or the resin segment) formed with styrene, butyl acrylate and acrylic acid and the resin (or the resin segment) formed with styrene, butyl acrylate and methacrylic acid both have at least a chemical bond constituting polyacrylate. Therefore, these two resins are the same kind of resins. Further examples are as follows. The resin (or the resin segment) formed with styrene, butyl acrylate and acrylic acid and the resin (or the resin segment) formed with styrene, butyl acrylate, acrylic acid, terephthalic acid, and fumaric acid both have at least a chemical bond constituting polyacrylate. Therefore, these two resins are also the same kind of resins.

The second resin is preferably a vinyl resin, a urethane resin, a urea resin, and the like.

The second resin of the present invention is most preferably a vinyl resin. It is because the vinyl resin having a main chain composed of carbon has a low affinity with a polyester resin having ester bonds in the main chain, and the compatibility between the second resin and the first resin can be inhibited.

(Vinyl Resin)

The vinyl resin is a resin obtained by polymerization of at least a vinyl monomer.

Specific examples of an amorphous vinyl resin are an acrylic monomer, a styrene-acrylic resin, and the like. Among these, an amorphous vinyl resin is preferably a styrene-acrylic resin derived from a styrene monomer and a (meth)acrylate monomer.

The content of the styrene-acrylic resin is preferably in the range of 55% to 85% by mass, more preferably in the range of 60% to 80% by mass based on the amount of the overall toner. The styrene-acrylic resin contained within this range enables to control the volume resistivity of the toner.

As vinyl monomers to form an amorphous vinyl resin, the following may be used. The vinyl monomers may be used alone, or may be used in combination of two or more kinds.

(1) Styrene Monomers:

styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, and derivatives of these monomers.

(2) (Meth)acrylic Acid Ester Monomers:

methyl (meth)acrylate, ethyl (meth)acrylate, n-butyl (meth)acrylate, iso-propyl (meth)acrylate, iso-butyl (meth) acrylate, t-butyl (meth)acrylate, n-octyl (meth)acrylate, 2-ethylhexyl (meth)acrylate, stearyl (meth)acrylate, lauryl (meth)acrylate, phenyl (meth)acrylate, diethylaminoethyl (meth)acrylate and dimethylaminoethyl (meth)acrylate, and derivatives of these monomers.

(3) Vinyl Ester Monomers:

vinyl propionate, vinyl acetate, and vinyl benzoate.

(4) Vinyl Ether Monomers:

vinyl methyl ether and vinyl ethyl ether.

(5) Vinyl Ketone Monomers:

vinyl methyl ketone, vinyl ethyl ketone and vinyl hexyl ketone.

(6) N-Vinyl Monomers:

N-vinyl carbazole, N-vinyl indole, and N-vinyl pyrrolidone.

(7) Others:

vinyl compounds such as vinylnaphthalene and vinylpyridine; acrylic acid or methacrylic acid derivatives such as acrylonitrile, methacrylonitrile, and acrylamide.

It is preferable to use vinyl monomers containing ionic-dissociative group such as a carboxy group, a sulfonic acid group or a phosphoric acid group. Specific examples are as follows.

Examples of a monomer containing a carboxy group are: acrylic acid, methacrylic acid, maleic acid, itaconic acid, cinnamic acid, fumaric acid, monoalkyl maleate, and monoalkyl itaconate. Examples of a monomer containing a sulfonic acid group are: styrenesulfonic acid, allylsulfosuccinic acid, and 2-acrylamido-2-methylpropanesulfonic acid.

An example of a monomer containing a phosphoric acid group is acid phosphooxyethyl methacrylate.

Further, the amorphous vinyl resin may be changed into a cross-linked resin by using poly-functional vinyl compounds as vinyl monomers. Examples of a poly-functional vinyl compound include: divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentylglycol dimethacrylate, and neopentylglycol diacrylate.

The glass transition temperature of the amorphous resin is preferably 40 to 70° C. and more preferably 45 to 65° C. The glass transition temperature of the amorphous resin being in the above range ensures both low-temperature fixability and heat-resistant storage properties.

The glass transition temperature of the amorphous resin is a value measured by using Diamond DSC (from PerkinElmer Inc.).

The measurement procedure of the glass transition temperature includes the followings: enclosing 3.0 mg of a measurement sample (amorphous resin) in an aluminum pan; setting the aluminum pan on a holder; performing temperature control of Heat-Cool-Heat with measurement conditions of a measurement temperature of 0° C. to 200°

C., a temperature rising rate of 10° C./min, and a temperature falling rate of 10° C./min; making an analysis on the basis of data obtained in the 2nd Heat; drawing an extension of a baseline before rising of the first melting peak and a tangent indicating the maximum inclination between the rising part of the first melting peak and the peak top; and taking the intersection point of the baseline and the tangent as the glass transition point. As a reference, an empty aluminum pan is used.

The weight average molecular weight (Mw) of the amorphous resin is measured with gel permeation chromatography (GPC) and preferably from 10,000 to 100,000. In the present invention, the molecular weight of the amorphous resin measured with GPC is measured as follows. Specifically, a device "HLC-8120 GPC" (TOSOH Corp.) and a column set "TSK guard column+3×TSK gel Super HZM-M" (TOSOH Corp.) are used. The column temperature is held at 40° C., and tetrahydrofuran (THF) is supplied at a flow rate of 0.2 ml/min as a carrier solvent. The measuring sample (amorphous resin) is dissolved in tetrahydrofuran to a concentration of 1 mg/mL by a treatment with an ultrasonic disperser at room temperature for 5 minutes. The solution is then treated with a membrane filter having a pore size of 0.2 μm to obtain a sample solution. 10 μl of the sample solution is injected into the device along with the carrier solvent and is detected by means of a refractive index detector (RI detector). The molecular weight distribution of the sample is calculated by using a calibration curve, which is determined by using standard monodisperse polystyrene particles. Ten kinds of polystyrene particles were used for making a calibration curve.

[Crystalline Resin]

The crystalline resin according to the present invention is a hybrid crystalline polyester resin composed of a segment composed of a first resin and a segment composed of a second resin chemically bonded to each other.

The crystalline resin is a resin exhibiting a clear endothermic peak measured with differential scanning calorimetry (DSC), instead of a stepwise change of heat absorption. Here, "a clear endothermic peak" designates a peak having a half bandwidth within 15° C. in an endothermic curve obtained by measurement with differential scanning calorimetry (DSC) under the condition of a temperature raising rate of 10° C./min.

The content of the hybrid crystalline polyester resin in the toner base particles is in a range of 5% to 30% by mass, and more preferably 10% to 20% by mass based on the amount of the toner base particles. It is preferable to make the content of the hybrid crystalline polyester resin in the toner base particles to be 30% by mass or less, because the insufficient crystalline growth of polyester resin can be avoided, and as a result, the crystal can be grown sufficiently during fixation. It is preferable to make the content of the hybrid crystalline polyester resin in the toner base particles to be 5% by mass or more, because the hybrid crystalline polyester resin necessary for crystallization can be contained enough, and as a result, the crystal can be grown sufficiently during fixation.

<First Resin: Crystalline Polyester Resin>

The first resin according to the present invention is a crystalline polyester resin.

Here, the crystalline polyester resin is a crystalline resin obtained by a polycondensation reaction between a two or more valent carboxylic acid (a polyvalent carboxylic acid compound) and a two or more valent alcohol (a polyhydric alcohol compound).

The polyvalent carboxylic acid compound refers to a compound having two or more carboxy groups in one molecule. Alkyl esters, acid anhydrides, and acid chlorides of a polyvalent carboxylic acid can be used. Examples of such polyvalent carboxylic acid include oxalic acid, succinic acid, maleic acid, adipic acid, β-methyladipic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, fumaric acid, citraconic acid, diglycolic acid, cyclohexane-3,5-diene-1,2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorphthalic acid, chlorphthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and dodecenylsuccinic acid. Examples of a three or more valent carboxylic acid include trimellitic acid, pyrromellitic acid, naphthalenetricarboxylic acid, naphthalenetetracarboxylic acid, pyrenetricarboxylic acid, and pyrenetetracarboxylic acid. These carboxylic acids may be used in combination.

The polyhydric alcohol compound refers to a compound having two or more hydroxy groups in one molecule. Examples of the diol include ethylene glycol, propylene glycol, 1,4-butanediol, diethylene glycol, 1,6-hexanediol, 1,4-cyclohexanediol, 1,8-octanediol, 1,10-decanediol, 1,12-dodecanediol, ethylene oxide adducts of bisphenol A, and propylene oxide adducts of bisphenol A. Examples of a three or more valent alcohol include glycerin, pentaerythritol, hexamethylolmelamine, hexaethylolmelamine, tetramethylolbenzoguanamine, and tetraethylolbenzoguanamine.

A variety of known catalysts can be used in preparation of the segment of the first resin. For example, an esterifying catalyst can be used.

Examples of esterifying catalysts include tin compounds, such as dibutyltin oxide and tin(II) 2-ethylhexanoate; and titanium compounds, such as titanium di(isopropoxy)-bis (triethanolaminato). Examples of esterification cocatalysts include gallic acid. The esterifying catalyst is used in an amount of preferably 0.01 to 1.5 parts by mass, more preferably 0.1 to 1.0 part by mass relative to the total amount (100 parts by mass) of the polyhydric alcohol, the polyvalent carboxylic acid compound, and the bireactive monomer component. The esterifying cocatalyst is used in an amount of preferably 0.001 to 0.5 parts by mass, more preferably 0.01 to 0.1 parts by mass relative to the total amount (100 parts by mass) of the polyhydric alcohol, the polyvalent carboxylic acid compound, and the bireactive monomer component.

Examples of the combination of the polyvalent carboxylic acid compound with the polyhydric alcohol for forming the crystalline polyester resin used in the present invention includes 1,12-dodecanediol (12 carbons) with sebacic acid (10 carbons), ethylene glycol (2 carbons) with sebacic acid (10 carbos), 1,6-hexanediol (6 carbons) with dodecanedioic acid (12 carbons), 1,9-nonanediol (6 carbons) with dodecanedioic acid (12 carbons), and 1, 6-hexanediol (6 carbons) with sebacic acid (10 carbos).

The melting temperature (Tm) of the crystalline polyester resin particles is in the range of 65 to 90° C., more preferably in the range of 70 to 80° C. When Tm is in the range of 65 to 90° C., low-temperature fixability is not inhibited and heat-resistant storage properties are improved.

(Measurement of Melting Temperature of Crystalline Polyester Resin)

The melting temperature of crystalline polyester resin can be measured by differential scanning calorimetry (DSC).

For example, a DSC-7 differential scanning calorimeter (manufactured by PerkinElmer, Inc.) or a TACT/DX thermal analysis controller (manufactured by PerkinElmer, Inc.) can be used for the measurement. Specifically, a sample (4.50 mg) is sealed in an aluminum pan (KIT No. 0219-0041) and is placed on the sample holder of the "DSC-7" calorimeter. An empty aluminum pan is used for the reference measurement. The temperature control of heating-cooling-heating is performed under the conditions of a measurement temperature of 0° C. to 200° C., a heating rate of 10° C./min, and a cooling rate of 10° C./min. Based on the data during the second heating step, the temperature at the top of the endothermic peak is determined as the melting temperature.

The method for measuring melting temperature of crystalline polyester resin can also be applied to the method for measuring melting temperature of crystalline resin other than crystalline polyester resin.

<Hybrid Crystalline Polyester Resin>

The hybrid crystalline polyester resin is formed by chemically-bonding the first resin and the second resin. In the hybrid crystalline polyester resin, the portion derived from the first resin is referred to as "the segment of the first resin" and the portion derived from the second resin is referred to as "the segment of the second resin".

Preferably, the segment of the first resin and the segment of the second resin are chemically bonded to each other through a bireactive monomer component. The above segment of the first resin is composed of the crystalline polyester resin.

[The Segment of the First Resin]

The segment of the first resin composing the hybrid resin is composed of a crystalline polyester resin produced by a polycondensation reaction between a polyvalent carboxylic acid and a polyhydric alcohol in the presence of a catalyst. Here, specific examples of the polyvalent carboxylic acid and the polyhydric alcohol are as described above.

[The Segment of the Second Resin]

The segment of the second resin in the hybrid crystalline resin is composed of a resin obtained by polymerization of monomers to form the second resin. Here, any known monomer can be used as the monomer to form the second resin, as long as an amorphous resin can be formed. Examples of the monomer include above-mentioned vinyl monomer composing a vinyl resin.

The content (hybrid ratio) of the segment of the second resin based on the amount of the hybrid crystalline polyester resin is preferably in a range of 0.1% to 30% by mass, and more preferably in a range of 0.5% to 10% by mass. When the content is 0.1% by mass or more, the effect to promote crystallization is easily exhibited. When the content is 30% by mass or less, the effect to promote crystallization is easily exhibited because increase of compatibility is inhibited.

The above hybrid ratio is the ratio of the second resin based on the total amount of the first resin, the second resin, and the structure derived from the bireactive monomer component in the hybrid crystalline polyester resin.

[Bireactive Monomer]

The "bireactive monomer" indicates a monomer which combines the segment of the first resin with the segment of the second resin, and has both a group selected from the group consisting of a hydroxy group, a carboxy group, an epoxy group, a primary amino group, and a secondary amino group, which can bind to the segment of the first resin, and an ethylenically unsaturated group, which can bind to the segment of the second resin, in the molecule. The bireactive monomer preferably has both a hydroxy or carboxy group and an ethylenically unsaturated group. More preferably, the bireactive monomer has both a carboxy group and an ethylenically unsaturated group. Namely, vinylcarboxylic acid is preferred.

Specific examples of the bireactive monomer include acrylic acid, methacrylic acid, fumaric acid, and maleic acid. The bireactive monomer may be an ester of hydroxyalkyl (having 1 to 3 carbon atoms) acrylic acid, methacrylic acid, fumaric acid, and maleic acid. Preferred are acrylic acid, methacrylic acid and fumaric acid in view of reactivity. The segment of the first resin is combined with the segment of the second resin via the bireactive monomer.

The content of the bireactive monomer is preferably 1 to 10 parts by mass, more preferably 4 to 8 parts by mass relative to the total amount (100 parts by mass) of the monomer to form the segment of the second resin, from the viewpoint of improving the low temperature fixability, offset resistance at high temperature, and durability.

[Processes of Manufacturing Hybrid Crystalline Resin]

The hybrid crystalline resin can be prepared by an existing standard scheme. Typical examples of the process include:

(1) preliminarily polymerizing a segment of a first resin, reacting the segment of the first resin with a bireactive monomer, reacting the resultant with a monomer (for example, an aromatic vinyl monomer and a(n) (meth)acrylate ester monomer) for forming a segment of a second resin to prepare a hybrid crystalline resin;

(2) preliminarily polymerizing a segment of a second resin, reacting the segment of the second resin with a bireactive monomer, reacting the resultant with a polyvalent carboxylic acid and polyhydric alcohol for forming a segment of a first resin to prepare a hybrid crystalline resin; and (3) preliminarily polymerizing a segment of a first resin and a segment of a second resin separately, and reacting these segments with a bireactive monomer to combine these segments.

In the present invention, any one of these processes can be used. Preferred is Process (2) described above. Specifically, a polyvalent carboxylic acid and polyhydric alcohol for forming a segment of a first resin are mixed with a monomer for forming a segment of a second resin and a bireactive monomer. A polymerization initiator is added, and the monomer for forming the segment of the second resin and the bireactive monomer are subjected to addition polymerization to prepare the segment of the second resin. Subsequently, an esterifying catalyst is added, and a polycondensation reaction is performed.

Here, a variety of known catalysts can be used in preparation of the segment of the first resin. Examples of esterifying catalysts include tin compounds, such as dibutyltin oxide and tin(II) 2-ethylhexanoate; and titanium compounds, such as titanium di(isopropoxy)-bis(triethanolaminato). Examples of esterification cocatalysts include gallic acid (3,4,5-Trihydroxybenzoic acid).

<Measurement of Volume-Based Median Diameter (Da) of Toner Base Particle>

The volume-based median diameter (Da) of the toner base particles is measured and calculated using a measurement apparatus configured by connecting "Multisizer 3" (from Beckman Coulter Inc.) to a computer system installed with data processing software "Software V3.51". More specifically, 0.02 g of a sample to be measured (toner) is added to, and mixed with 20 ml of a surfactant solution (a surfactant solution prepared typically by diluting a neutral detergent containing a surfactant component with pure water by 10 times in mass, aimed at dispersing the toner particle), and the mixture is allowed to disperse by sonication to prepare a toner particle dispersion liquid. The toner particle dispersion liquid is pipetted into a beaker placed in a sample stand, which contains "ISOTON II" (from Beckman Coulter Inc.), until the concentration displayed on the measurement apparatus reaches 80. With the concentration adjusted within this range, the obtained measurement values will be well reproducible. The number of particles to be measured and the aperture are set to 25000 and 100 μm, respectively, on the measurement apparatus. The measurement range from 2 to 60 μm is divided into 256 sections to calculate frequency values, wherein a 50% particle diameter counted down from the maximum volume-based cumulative median diameter is denoted as the volume-based median diameter.

<Colorant>

The colorant usable in the toner base particles according to the present invention can be any known inorganic or organic colorant. Examples of such a colorant include carbon black, magnetic powder, a variety of organic and inorganic pigments and dyes. The colorant is added in an amount of 1 to 30 mass %, preferably 2 to 20 mass % based on the amount of the toner base particles.

<Release Agent>

The toner base particles according to the present invention can contain a release agent. A preferred release agent is wax. Examples of wax include hydrocarbon waxes, such as low molecular weight polyethylene wax, low molecular weight polypropylene wax, Fischer-Tropsch wax, microcrystalline wax, and paraffin wax; and ester waxes, such as carnauba wax, pentaerythritol behenic acid ester, behenyl behenate, and behenyl citrate. These release agents can be used alone or in combination.

A wax having a melting point of 50 to 95° C. is preferably used to attain a toner releasable and fixable at low temperature. The content of the wax is preferably 2 to 20 mass %, more preferably 3 to 18 mass %, most preferably 4 to 15 mass % relative to the total amount of the binder resin.

The wax contained in the toner particles preferably forms domains to attain a releasing effect. The wax domains formed in the binder resin readily attain the respective functions.

The diameter of the wax domain ranges preferably from 300 nm to 2 μm. A wax domain having a diameter in this range attains a sufficient releasing effect.

<Charge Control Agent>

The toner matrix particles according to the present invention can contain an optional charge control agent. A variety of known charge control agents can be used.

Examples of such a charge control agent include a variety of known compounds which can be dispersed in aqueous media. Specific examples thereof include nigrosine dyes, metal salts of naphthene acid or higher fatty acids, alkoxylated amines, quaternary ammonium salts, azo metal complexes, and metal salts or complexes of salicylic acid.

The content of the charge control agent is preferably 0.1 to 10 mass %, more preferably 0.5 to 5 mass % relative to the total amount of the binder resin.

<<External Additives>>

[Particles Containing Fatty Acid Metal Salt]

The particles containing a fatty acid metal salt preferably contains a salt of a metal selected from the group consisting of zinc, calcium, magnesium, aluminum, and lithium as a fatty acid metal salt. Among these metal salts, particularly preferred are zinc, calcium, lithium, and magnesium salts of fatty acids for excellent lubricity. Preferred fatty acids for the fatty acid metal salts are higher fatty acids having 12 to 22 carbon atoms. Fatty acid having 12 or more carbon atoms can prevent generation of free fatty acid. A fatty acid having 22 or less carbon atoms can prevent a significant increase in the melting temperature of the fatty acid metal salt, attaining preferred fixing characteristics. Particularly preferred fatty acid is stearic acid. Particularly preferred fatty acid metal salts used in the present invention are zinc stearate, calcium stearate, lithium stearate, and magnesium stearate.

The particles containing a fatty acid metal salt according to the present invention can contain other materials such as a metal salt other than the fatty acid metal salt, as long as it does not inhibit the effect of the present invention.

<Measurement of Volume-Based Median Diameter (Db) of Particles Containing Fatty Acid Metal Salt>

The volume-based median diameter (Db) of the particles containing a fatty acid metal salt used in the present invention is measured based on the method described in JIS Z8825-1 (2001). Details are described below.

As a measurement apparatus, a laser diffraction type particle size distribution measuring apparatus (LA-920 manufactured by HORIBA Ltd.) can be used. Special software "HORIBA LA-920 WET(LA-920) Ver. 2.02", which is provided with LA-920, can be used for controlling measurement conditions and analyzing measured data. Deionized water is used as a measuring solvent, after removing solid impurities. A specific measurement method is as follows.

(1) A batch type cell holder is attached to LA-920.

(2) A certain amount of deionized water is placed in a batch type cell the batch type cell is attached to the batch type cell holder.

(3) The interior of the batch type cell is stirred with a special stirrer chip.

(4) The file "110A000I" (relative reflective index of 1.10) is selected by pushing the "reflective index" button on the "display display condition setting" screen.

(5) Volume-based median diameter is set as the particle diameter on "display condition setting" screen.

(6) After warming-up operation for 1 hour or more, adjustment of optical axis, fine adjustment of optical axis, and measurement of blanks are performed.

(7) About 60 ml of deionized water is placed in a glass 100 ml flat bottom beaker. About 0.3 ml of dilute solution a dispersant is added to the deionized water. The diluted solution is obtained by diluting "Contaminon N" (a 10 mass % aqueous solution of a neutral detergent for washing a precision measuring apparatus, containing a nonionic surfactant, an anionic surfactant and an organic builder, pH7, manufactured by Wako Pure Chemical Industries Ltd) with deionized water by 3 times in mass;

(8) An ultrasonic disperser "Ultrasonic Dispension System Tetora 150" (made by Nikkaki-Bios Co., Ltd.) is prepared, which has an electrical output of 120 W and two oscillators having an oscillation frequency of 50 kHz. 3.3 L of ion exchange water is placed in a water bath of the ultrasonic disperser, and 2 mL of CONTAMINONN is added to the water bath.

(9) The beaker described in (7) is set in a beaker fixing hole of the ultrasonic disperser, and the ultrasonic disperser is operated. The vertical position of the beaker is adjusted such that the resonance at the surface of the aqueous solution in the beaker is the maximum.

(10) While the aqueous solution in the beaker described in (9) is irradiated with an ultrasonic wave, about 1 mg of the particles containing a fatty acid metal salt are added to the aqueous solution little by little, and dispersed. Further, the ultrasonic dispersing treatment is continued for 60 seconds. When the particles containing a fatty acid metal salt aggregate and float on the surface of the solution, they are immersed in water by shaking the beaker, and the ultrasonic dispersing treatment is continued for 60 seconds. In the ultrasonic dispersing treatment, the temperature of water in the water bath is properly adjusted such that the temperature is not less than 10° C. and not more than 40° C.

(11) By immediately adding the aqueous solution described in (10) dispersed with the particles containing a fatty acid metal salt to the batch type cell little by little with taking care not to generate air bubbles, the transmission rate of the tungsten lamp is adjusted between 90 to 95%. The measurement of particle size distribution is performed. The volume-based median diameter (Db) is calculated from the obtained data of volume-based particle size distribution.

<<Expressions (1) and (2)>>

The volume-based median diameter (Da) of the toner base particles and the volume-based median diameter (Db) of the particles containing a fatty acid metal salt satisfy the relations represented by Expressions (1) and (2) below:

$$0.5\ \mu m \leq Db \leq 2.0\ \mu m \quad \text{Expression (1)}$$

$$0.1\ Db/Da \leq 0.5 \quad \text{Expression (2)}$$

For obtaining the effect of the present invention more preferably, the volume-based median diameter (Da) of the toner base particles preferably satisfies the relation represented by Expression (3) below:

$$3.5\ \mu m \leq Da \leq 9.0\ \mu m \quad \text{Expression (3)}$$

[Other External Additives]

From the viewpoint of controlling the fluidity and/or chargeability of the toner particles, further external additives other than the particles containing a fatty acid metal salt are preferably included. The external additives may be used alone or combination. Examples of the external additives include particles of silica, titania, alumina, zirconia, zinc oxide, chromium oxide, cerium oxide, antimony oxide, tungsten trioxide, tin oxide, tellurium oxide, manganese oxide, and boron trioxide.

The external additive described above preferably contains silica particles prepared through a sol-gel process. The silica particles prepared through a sol-gel process has narrow particle size distribution and therefore is preferable from the viewpoint of suppressing unevenness of adhesion strength between the toner base particles and the external additive.

A number average primary particle diameter of the silica particles is preferably in the range of 70 to 200 nm. The silica particles having a number average primary particle diameter in the above range are larger than other external additives and exert spacer effect in the two-component developer. Such silica particles are preferable in view of preventing embedment of other smaller external additives into the toner base particles during agitation of the two-component developer in a developing device and in view of preventing fusion of toner base particles with each other.

The number average primary particle diameter of the above-described external additives can be calculated by processing an image observed under a transmission electron microscope (TEM), and can be controlled by classification treatment and/or mixing classified particles, for example.

The surface of above external additives are preferably subjected to hydrophobization process. Any known surface treatment agent can be used for the hydrophobization process. Examples of the surface treatment agent include silane coupling agents, silicone oils, titanate coupling agents, aluminate coupling agents, fatty acids, metallic salts of fatty acids, esters thereof, and rosin acid. They may be used alone or combination.

Examples of the silane coupling agent include dimethyldimethoxysilane, hexamethyldisilazane (HMDS), methyltrimethoxysilane, isobutyltrimethoxysilane, and decyltrimethoxysilane. Examples of the silicone oil include cyclic, linear, and branched organosiloxanes, such as organosiloxane oligomers, octamethylcyclotetrasiloxane, decamethylcyclopentasiloxane, tetramethylcyclotetrasiloxane, and tetravinyltetramethylcyclotetrasiloxane.

<<Processes of Manufacturing Toner>>

The toner according to the present invention can be manufactured by any known process. Preferred examples of the process include an emulsion polymerization aggregation process and an emulsion aggregation process.

An emulsion polymerization aggregation process which is preferably used for manufacturing the toner according to the present invention includes steps of mixing a dispersion liquid of microparticles of binder resin prepared by an emulsion polymerization process (hereinafter, also referred to as "binder resin microparticles"), a dispersion liquid of microparticles of a colorant (hereinafter, also referred to as "colorant microparticles") and a dispersion liquid of a releasing agent such as wax; allowing aggregation to proceed until a predetermined toner particle size is reached; and controlling the shape of the particles by fusing the binder resin microparticles.

An emulsion aggregation process which is preferably used for manufacturing the toner according to the present invention includes steps of adding dropwise a solution of a binding resin dissolved in a solvent to a poor solvent to prepare a dispersion liquid of the resin particles, mixing the resin particle dispersion liquid, a dispersion liquid of colorants, and a dispersion liquid of a releasing agent such as wax, allowing aggregation to proceed until a predetermined toner particle size is reached; and controlling the shape of the particles by fusion of the binder resin microparticles.

For manufacturing the toner according to the present invention, both processes can be applied.

An emulsion polymerization aggregation process is shown below as an example of manufacturing the toner according to the present invention.

(1) A step of preparing a dispersion liquid in which colorant microparticles are dispersed in an aqueous medium;

(2) A step of preparing a dispersion liquid in which binder resin microparticles, optionally containing an internal additive, are dispersed in an aqueous medium;

(3) A step of preparing a dispersion liquid of binder resin microparticles by emulsion polymerization;

(4) A step of forming toner base particles by mixing the dispersion liquid of colorant microparticles and the dispersion liquid of binder resin microparticles to aggregate, associate, and fuse the colorant microparticles and the binder resin microparticles;

(5) A step of filtering the dispersion system (the aqueous medium) of toner base particles to separate the toner base particles for removing, for example, a surfactant;

(6) A step of drying the toner base particles; and (7) A step of adding an external additive to the toner base particles.

In the process of manufacturing toner by the emulsion polymerization aggregation process, the binder resin microparticles prepared by the emulsion polymerization process may have a multi-layered structure of two or more layers each composed of a binder resin having a different composition. The binder resin microparticles having a two-layer structure, for example, can be provided by preparing a dispersion liquid of binder resin particles according to the conventional emulsion polymerization process (first stage polymerization), followed by adding a polymerization initiator and a polymerizable monomer into the dispersion liquid to proceed the polymerization (second stage polymerization).

Toner particles having a core shell structure can be prepared by the emulsion polymerization aggregation process. The toner particles having a core shell structure can be prepared as follows. At first, core particles are prepared by aggregation, association and fusion of the binder resin microparticles for the core particles and the colorant microparticles. Then binder resin microparticles for the shell layer are added to the core particle dispersion liquid so as to aggregate and fuse onto the surface of the core particles, resulting in formation of the shell layer for covering the surface of the core particles, whereby the toner particles having the core shell structure are prepared.

A pulverization process is shown as an example of manufacturing toner of the present invention.

(1) A step of mixing a binder resin, a colorant, and an internal additive as necessary with, for example, a Henschel mixer;

(2) A step of kneading the resulting mixture with, for example, an extrusion kneader with heating;

(3) A step of coarsely pulverizing the resulting kneaded material with, for example, a hammer mill, followed by further pulverizing with, for example, a turbo mill pulverizer; (4) A step of forming toner base particles by powder classification process of the resulting pulverized material, for example, through an air sifter based on a Coanda effect; and (5) A step of adding external additives to toner base particles.

[Particle Diameter of Toner Particles]

The particle diameter of toner particles according to the present invention is a volume-based median diameter in the range of preferably 4 to 10 μm, and more preferably 5 to 9 μm.

The toner particles having a volume based median diameter within the above range causes high transfer efficiency and can increase half tone image quality and thus high quality image of fine lines and dots can be obtained.

The volume-based median diameter of the toner particles can be measured and calculated using a device of "Multisizer 3" (Beckman Coulter Inc.) connected to a computer system (Beckman Coulter Inc.) for data processing.

More specifically, 0.02 g of toner is added to, and mixed with 20 ml of a surfactant solution (a surfactant solution prepared typically by diluting a neutral detergent containing a surfactant component with pure water by 10 times in mass, aimed at dispersing the toner particles), and the mixture is allowed to disperse by sonication to prepare a toner particle dispersion liquid. The toner particle dispersion liquid is pipetted into a beaker placed in a sample stand, which contains "ISOTON II" (from Beckman Coulter Inc.), until the concentration displayed on the measurement apparatus reaches 8%. With the concentration adjusted within this range, the obtained measurement values will be well reproducible. The number of particles to be measured and the aperture are set to 25000 and 50 μm, respectively, on the measurement apparatus. The measurement range from 1 to 30 μm is divided into 256 sections to calculate frequency values, wherein a 50% particle diameter counted down from the maximum volume-based cumulative median diameter is denoted as the volume-based median diameter.

<<Two-Component Developer for Electrostatic Image>>

The toner according to the present invention can be used in the form of a two-component developer for electrostatic image prepared by mixing the toner particles and carrier particles such that the toner particle content (toner concentration) is 4.0 to 8.0 mass %.

Examples of the mixing machine include Nauta mixers, W corn, and V-type mixers.

[Carrier Particles]

The carrier particles are composed of a magnetic material. For example, the carrier particles are categorized into coated type carrier particles having a core particle composed of the magnetic material (a carrier core) and a coating material covering the surface of the core (a carrier coating resin) and resin dispersion type carrier particles composed of dispersion of a resin and fine powder of magnetic material. Carrier particles of a coated type are preferred which barely adhere on photoreceptors.

<Core Particles>

The core particles are composed of, for example, a magnetic material strongly magnetized in the direction of a magnetic field. The magnetic materials may be used alone or in combination. Examples of the material include ferromagnetic metals, such as iron, nickel, and cobalt, alloys and compounds containing these metals, and alloys exhibiting ferromagnetic characteristics after heat treatment.

Examples of ferromagnetic metals and compounds containing the metals include iron, ferrite represented by Formula (a), and magnetite represented by Formula (b), where Min Formulae (a) and (b) is at least one monovalent or divalent metal selected from the group consisting of Mn, Fe, Ni, Co, Cu, Mg, Zn, Cd, and Li.

$$MO.Fe_2O_3 \qquad \text{Formula (a):}$$

$$MFe_2O_4 \qquad \text{Formula (b):}$$

Examples of the alloy exhibiting ferromagnetic characteristics after heat treatment include Heusler alloys, such as manganese-copper-aluminum and manganese-copper-tin, and chromium dioxide.

Preferably the core particles are composed of ferrite. Since the specific gravity of the coated type carrier particles is smaller than the specific gravity of the core particle metal, the core-shell structure can reduce impact force occurring during agitation in the developing vessel.

<Coating Material>

One or more coating material may be used. The coating material may be any known resin that is used for covering the cores of the carrier particles. The coating material is preferably a resin having a cycloalkyl group that can reduce moisture adsorption of the carrier particles and enhance adhesiveness of the coating layers to the core particles. Examples of the cycloalkyl group include cyclohexyl, cyclopentyl, cyclopropyl, cyclobutyl, cycloheptyl, cyclooctyl, cyclononyl, and cyclodecyl groups. Among these groups preferred are cyclohexyl and cyclopentyl groups. More preferred is a cyclohexyl group in view of adhesiveness of the coating layers to the ferrite particles. The resin has a weight-average molecular weight (Mw) in the range of, for example, 10,000 to 800,000, more preferably 100,000 to 750,000. The resin has a cycloalkyl group content of, for example, 10% to 90% by mass. The cycloalkyl group content of the resin can be determined, for example, pyrolysis gas chromatography-mass spectrometry (P-GC/MS) and $^1$H-NMR.

The applicable embodiments of the present invention are not limited to the embodiments described above. They may be suitably changed within the scope of not exceeding the object of the present invention.

Examples

In the following examples, "part(s)" and "%" indicate "parts by mass" and "% by mass", respectively, unless otherwise specified. Each operation was carried out at room temperature (25° C.), unless otherwise specified. The examples should not be construed to limit the present invention.

[Preparation of Toner 1]

[Preparation of Amorphous Resin Microparticle Dispersion Liquid (A1)]

(First-Stage Polymerization)

Into a reaction vessel provided with a stirrer, a thermosensor, a cooling tract, and a nitrogen inlet, 4 parts by mass of polyoxyethylene (2) dodecyl ether sodium sulfate and 3000 parts by mass of deionized water were fed, and the internal temperature was raised to 80° C. while the mixture was stirred at a rate of 230 rpm in a nitrogen stream. After the heating, a solution of 10 parts by mass of potassium persulfate in 200 parts by mass of deionized water was added. At a solution temperature of 75° C., a mixed monomer solution consisting of:

| | |
|---|---|
| styrene | 584 parts by mass, |
| n-butyl acrylate | 160 parts by mass, and |
| methacrylic acid | 56 parts by mass |

was added dropwise over 1 hour, and was heated with stirring at 75° C. for 2 hours for polymerization. A dispersion liquid of binder resin microparticles [a1] was thereby prepared.

(Second-Stage Polymerization)

Into a reaction vessel provided with a stirrer, a thermosensor, a cooling tract, and a nitrogen inlet, 2 parts by mass of polyoxyethylene (2) dodecyl ether sodium sulfate and 3000 parts by mass of deionized water were fed, and the solution was heated to 80° C. After the heating, a solution of 42 parts by mass (solid content) of the above binder resin microparticles [a1] and 70 parts by mass of microcrystalline wax "HNP-0190" (made by Nippon Seiro Co., Ltd.) dissolved in a monomer mixture consisting of:

| | |
|---|---|
| styrene | 239 parts by mass, |
| n-butyl acrylate | 111 parts by mass, |
| methacrylic acid | 26 parts by mass, and |
| n-octyl mercaptan | 3 parts by mass |

was added at 80° C., and the mixture was dispersed for 1 hour in a mechanical disperser "CLEARMIX" (made by M Technique Co., Ltd.) with a circulation pathway. A dispersion liquid containing emulsified particles (oil droplets) was thereby prepared.

After an initiator solution of 5 parts by mass of potassium persulfate in 100 parts by mass of deionized water was added to the dispersion liquid, the system was heated with stirring at 80° C. for 1 hour for polymerization. A dispersion liquid of binder resin microparticles [a2] was thereby prepared.

(Third-Stage Polymerization)

A solution of 10 parts by mass of potassium persulfate in 200 parts by mass of deionized water was added to the dispersion liquid of binder resin microparticles [a2] described above, and a monomer mixture consisting of:

| | |
|---|---|
| styrene | 380 parts by mass, |
| n-butyl acrylate | 132 parts by mass, |
| methacrylic acid | 39 parts by mass, and |
| n-octyl mercaptan | 6 parts by mass |

was added dropwise over 1 hour at 80° C. After dropwise addition, the solution was heated with stirring for 2 hours for polymerization, and then was cooled to 28° C., to prepare amorphous resin microparticle dispersion liquid (A1) which is a dispersion liquid of microparticles of a vinyl resin (the second resin) having acid group(s).

[Preparation of Crystalline Resin]

(Synthesis of Crystalline Resin (C1))

In a reaction vessel provided with a nitrogen inlet, a dehydration tract, a stirrer, and a thermocouple, 274 parts by mass of sebacic acid (molecular weight 202.25) as a polyvalent carboxylic acid compound and 274 parts by mass of 1,12-dodecanediol (molecular weight 202.33) as a polyhydric alcohol compound for a crystalline polyester polymerization segment (a segment of a first resin) were heated to 160° C. to dissolve the content. A solution of 23 parts by mass of styrene, 6 parts by mass of n-butyl acrylate, 4 parts by mass of dicumyl peroxide, and 2 parts by mass of acrylic acid as a bireactive monomer, which are materials for vinyl-based polymerization segment (a segment of a second resin) preliminarily mixed, is added dropwise over 1 hour with a dropping funnel. After stirring for 1 hour at 170° C. for polymerization of styrene, n-butyl acrylate, and acrylic acid, 2.5 parts by mass of tin(II) 2-ethylhexanoate and 0.2 parts by mass of gallic acid were added and the mixture was heated to 210° C. for 8 hours for reaction and then 1 hour under a pressure of 8.3 kPa to prepare a crystalline resin (C1), which is a hybrid crystalline polyester resin composed of a segment of a first resin and a segment of a second resin chemically bonded to each other.

[Preparation of Crystalline Resin Microparticle Dispersion Liquid 1]

30 parts by mass of the crystalline resin (C1) was melted, and the resin in the melted state was transferred to an emulsifying disperser "Cavitron CD1010" (manufactured by Eurotec) at a transfer rate of 100 parts by mass per minute. Concurrently with the transfer of the crystalline resin (C1) in the melted state, a dilute ammonia solution having a concentration of 0.37% by mass was transferred to the emulsifying disperser at a transfer rate of 0.1 L per minute while being heated to 100° C. with a heat exchanger. The dilute ammonia solution was prepared in an aqueous solvent tank by diluting a reagent ammonia water (70 parts by mass) with deionized water. The emulsifying disperser was operated under conditions of a rotation rate of the rotor of 60 Hz and a pressure of 5 kg/cm$^2$ to prepare a crystalline resin particle dispersion liquid 1 containing crystalline resin particles having a volume-based median diameter of 200 nm and a solid content of 30 parts by mass.

[Preparation of Colorant Nanoparticle Dispersion Liquid (Bk)]

While a solution of sodium dodecyl sulfate (90 parts by mass) in deionized water (1600 parts by mass) was being stirred, carbon black "REGAL 330R" (available from Cabot Corporation, 420 parts by mass) was gradually added, and then was dispersed with a stirrer "Cleamix" (available from M Technique Co., Ltd.) to prepare colorant microparticle dispersion liquid (Bk).

The diameter of the colorant microparticles in the colorant microparticle dispersion liquid (Bk) was 110 nm from the measurement with an electrophoretic light scattering photometer ELS-800 (available form Otsuka Electronics Co., Ltd.).

<Preparation of Toner Base Particles [1]>

(Steps of Aggregation and Fusion)

Into a reaction vessel provided with a stirrer, a thermosensor, a cooling tract, and a nitrogen inlet, 300 parts by mass (solid content) of the amorphous resin microparticle dispersion liquid (A1), 60 parts by mass (solid content) of the crystalline resin microparticle dispersion liquid 1, 1100 parts by mass of deionized water, 40 parts by mass (solid content) of the colorant nanoparticle dispersion liquid (Bk) are fed, and the solution was adjusted to 30° C. A 5N sodium hydroxide aqueous solution was added to adjust the pH to 10. An aqueous solution of magnesium chloride (60 parts by mass) in deionized water (60 parts by mass) was added under stirring at 30° C. for 10 minutes. After being kept for three minutes, the system was heated to 85° C. over 60 minutes. While the system was kept at 85° C., the reaction was continued to grow particles. In this state, the diameter of aggregated particles was measured with a particle size analyzer "Coulter Multisizer III" (from Beckman Coulter Inc.). When the volume-based median diameter reached 6 μm, an aqueous solution of sodium chloride (40 parts by mass) in deionized water (160 parts by mass) was added to terminate the growth of particles. In the next fusion step, the solution was heated with stirring for 1 hour at a solution temperature of 80° C. to fuse the particles and to prepare a dispersion liquid of toner base particles [1]. The diameter of the particles reached 6.0 μm.

(Steps of Washing and Drying)

The obtained toner base particles were separated with a basket centrifuge "MARK III 60×40+M" (available from Matsumoto Machine Manufacturing Co., Ltd.) to prepare wet cake of toner base particles. The wet cake was washed with deionized water at 40° C. in the basket centrifuge until the electric conductivity of the filtrate reached 5 pS/cm. The wet cake was then placed in a "Flash Jet" dryer (available from Seishin Enterprise Co., Ltd.), and was dried until a moisture content of 0.5 mass %. Toner base particles [1] were thereby prepared.

[Preparation of Particles Containing Fatty Acid Metal Salt [D1]]

140 parts by mass of stearic acid was added to 1000 parts by mass of ethanol and mixed at 75° C. After slowly adding 50 parts by mass of zinc hydroxide to the mixture and stirring for 1 hour, the product was taken out by cooling to 20° C. and dried at 150° C. to remove ethanol. The obtained solid zinc stearate was coarsely pulverized with a hammer mill, pulverized with a jet stream type pulverizer "I-20 jet mill" (from Nippon Pneumatic Mfg. Co., Ltd.), classified using a cutpoint of 1.4 μo with a wind-force Shifter "DS-20/DS-10 Shifter" (from Nippon Pneumatic Mfg. Co., Ltd.), to prepare particles containing a fatty acid metal salt [D1] composed of zinc stearate having a volume-based median diameter (Db) of 0.97 μm.

(External Additive Adding Step)

The following powder materials are added to toner base particles [1] (100 parts by mass) and the mixture is stirred for 15 minutes at a tip peripheral speed of 40 m/s of blades in a Henschel mixer type "FM20C/I" (NIPPON COKE & ENGINEERING CO., LTD.) to prepare toner 1.

| | |
|---|---|
| sol-gel silica | 2.0 parts by mass, |
| hydrophobic silica | 2.5 parts by mass |
| hydrophobic titanium oxide | 0.5 parts by mass, and |
| particles containing a fatty acid metal salt [D1] | 0.30 parts by mass. |

The temperature of the mixed powder during the addition of the external additive to the toner particles 1 was set at 40±1° C. When the temperature increased to 41° C., the outer bath of the Henschel mixer was fed with cooling water at a flow rate of 5 L/min. When the temperature reduced to 39° C., the outer bath of the Henschel mixer was fed with cooling water at a flow rate of 1 L/min. The internal temperature of the Henschel mixer was thus adjusted.

[Preparation of Toners 2 to 21]

Toners 2 to 21 were prepared in the same way as toner 1, except that the volume-based median diameter (Da) of toner base particles (described as "diameter of base particles (Da)" in Table 3), the kind of crystalline resin, the crystalline resin content (described as "content" in Table 3), the kind and the added amount (parts by mass) of the particles containing a fatty acid metal salt, were changed as described in Table 3.

The volume-based median diameter of the toner base particles can be controlled by changing the timing of adding an aqueous solution of sodium chloride in the steps of aggregation and fusion <Crystalline Resin Content in Toner Base Particles>

The crystalline resin content (%) in the toner base particles was calculated from the following expression (solid content):

Crystalline resin content (%) in toner base particles=
(amount of crystalline resin (parts by mass))/{
(amount of amorphous resin (parts by mass))+
(amount of crystalline resin (parts by mass))+
(amount of colorant (parts by mass))}×100

For example, the crystalline resin content in the toner 1 is 15% by mass, which is calculated as the ratio of the crystalline resin microparticle dispersion liquid 1 (solid content, 60 part by mass) based on the total amount of the amorphous resin microparticle dispersion liquid (A1) (solid content, 300 part by mass), the crystalline resin microparticle dispersion liquid 1 (solid content, 60 part by mass), and the colorant nanoparticle dispersion liquid (Bk) (solid content, 40 part by mass) (see Table 3 below).

In preparation of toners 2 to 21, the amount of crystalline resin (%) in the toner base particles was controlled by changing the ratio of the amount of amorphous resin [parts by mass] and the amount of crystalline resin [parts by mass], without changing the amount of colorant [parts by mass].

<Synthesis of Crystalline Resin (C1)>

Crystalline resins (C2) to (C5) and (C7) were hybrid crystalline polyester resins which were synthesized in the same way as crystalline resin (C1), except that the ratio of materials for the segment of the first resin (the crystalline polyester polymerization segment) and for the segment of the second resin was changed and the content (hybrid ratio) of the segment of the second resin based on the amount of the hybrid crystalline polyester resin was changed. In synthesis of crystalline resin (C6), the segment of the second resin was not used.

TABLE 1

| HYBRID CRYSTALLINE POLYESTER RESIN No. | FIRST RESIN SEBACIC ACID [PARTS BY MASS] | FIRST RESIN 1,12-DODECANEDIOL [PARTS BY MASS] | SECOND RESIN STYRENE [PARTS BY MASS] | SECOND RESIN N-BUTYL ACRYLATE [PARTS BY MASS] | AMOUNT OF SECOND RESIN [PARTS BY MASS] | BIREACTIVE ACRYLIC ACID [PARTS BY MASS] | TOTAL AMOUNT OF RESIN [PARTS BY MASS] | HYBRID RATIO [% BY MASS] |
|---|---|---|---|---|---|---|---|---|
| C1 | 274 | 274 | 23.00 | 6.00 | 29.00 | 2 | 579.00 | 5.01 |
| C2 | 245 | 245 | 69.00 | 18.00 | 87.00 | 2 | 579.00 | 15.05 |
| C3 | 288 | 288 | 0.46 | 0.12 | 0.58 | 2 | 578.58 | 0.10 |
| C4 | 286 | 286 | 4.60 | 1.20 | 5.80 | 2 | 579.80 | 1.00 |
| C5 | 202 | 202 | 138.00 | 36.00 | 174.00 | 2 | 580.00 | 30.00 |
| C6 | 290 | 290 | 0.00 | 0.00 | 0.00 | 0 | 580.00 | 0.00 |
| C7 | 187 | 187 | 161.00 | 42.00 | 203.00 | 2 | 579.00 | 35.06 |

<Preparation of Crystalline Resin Microparticle Dispersion Liquids 2 to 7>

Crystalline resin microparticle dispersion liquids 2 to were prepared in the same way as crystalline resin microparticle dispersion liquid 1, except that crystalline resins (C2) to (C7) were used instead of crystalline resin (C1)

<Preparation of Particles Containing Fatty Acid Metal Salt [D2] to [D6]]

(Preparation of Particles Containing Fatty Acid Metal Salt [D2])

Particles containing a fatty acid metal salt [D2], composed of zinc stearate and having a volume-based median diameter (Db) of 1.94 μm, were prepared in the same way as the particles containing a fatty acid metal salt [D1], except that the cutpoint was changed from 1.4 μm to 2.3 μm.

(Preparation of Particles Containing Fatty Acid Metal Salt [D3])

Particles containing a fatty acid metal salt [D2], composed of zinc stearate and having a volume-based median diameter (Db) of 0.59 μm, were prepared in the same way as the particles containing a fatty acid metal salt [D1], except that the cutpoint was changed from 1.4 μm to 1.0 μm.

(Preparation of Particles Containing Fatty Acid Metal Salt [D5])

Particles containing a fatty acid metal salt [D5], composed of calcium stearate and having a volume-based median diameter (Db) of 1.31 μm, were prepared in the same way as the particles containing a fatty acid metal salt [D1], except that zinc hydroxide was changed to calcium hydroxide and the cutpoint was changed from 1.4 μm to 1.7 μm.

(Preparation of Particles Containing Fatty Acid Metal Salt [D6])

Particles containing a fatty acid metal salt [D6], composed of calcium stearate and having a volume-based median diameter (Db) of 5.54 μm, were prepared in the same way as the particles containing a fatty acid metal salt [D5], except that the cutpoint was changed from 1.7 μm to 6.0 μm.

(Particles Containing Fatty Acid Metal Salt [D4])

"ZnSt" (having a volume-based median diameter of 14.30 μm; manufactured by NOF Co. Ltd.) was used as particles containing fatty acid metal salt [D4].

Table 2 shows the kind of a fatty acid metal salt and the diameter of particles containing a fatty acid metal salt [D1] to [D6].

TABLE 2

| PARTICLES CONTAINING FATTY ACID METAL SALT No. | KIND OF FATTY ACID METAL SALT | MEDIAN DIAMETER (Db) [μm] |
|---|---|---|
| D1 | ZINC STEARATE | 0.97 |
| D2 | ZINC STEARATE | 1.94 |
| D3 | ZINC STEARATE | 0.59 |
| D4 | ZINC STEARATE | 14.30 |
| D5 | CALCIUM STEARATE | 1.31 |
| D6 | CALCIUM STEARATE | 5.54 |

<<Evaluation of Toners 1 to 21>>

[Preparation of Two-Component Developers 1 to 21]

Each of toner particles 1 to 21 and carrier particles 1 coated by the coating material 1 described below were weighed such that the toner particle content (concentration) in the two component developer was 7% by mass, and were mixed in a V-shaped mixer for 30 minutes to prepare and evaluate two-component developers 1 to 21 respectively using toners 1 to 21.

The coating material 1 and the carrier particles 1 were prepared as follows.

[Preparation of Core-Covering Resin (Coating Material 1)]

Cyclohexyl methacrylate and methyl methacrylate (molar ratio 1:1) was added to aqueous 0.3 mass % sodium benzenesulfonate solution, and potassium persulfate was added in an amount of 0.5 mass % of the total amount of monomers to proceed emulsion polymerization. The resin fine particles in the resulting dispersion were spray-dried to yield coating material 1 as a core-covering resin.

<Preparation of Carrier Particles 1>

Mn—Mg ferrite particles having a volume average diameter of 30 μm were provided as core particles. The ferrite particles (100 parts by mass) and shell material 1 (4.5 parts by mass) were placed in a high-rate stirring mixer provided with a horizontal stirring blade and were mixed with stirring at a peripheral velocity of 8 m/sec of the stirring blade at 22° C. for 15 minutes. The system was further mixed at 120° C. for 50 minutes to cover the core particles with coating material 1 by the effect of mechanical impact (mechanochemical process). The carrier particles 1 were thereby prepared. The carrier particles 1 had a volume-based median diameter (Dvc) of 30 μm.

[Evaluation Method]

<Document Offset Resistance>

An image forming apparatus "bizhub PRO™ C6500" provided with its exclusive finisher "FS-608" (made by Konica Minolta, Inc.) was used. The automatic product preparation test for 20 sets of inner-bound prints (one set: 5 sheets) was conducted repeatedly 50 times. In this automatic product preparation test, a pixel rate per one page was set to 50% and a paper sheet with a weight of 64 g/m$^2$ was used as an image recording sheet. The printed matters were cooled to a room temperature with natural cooling, and all pages of the printed matters were visually checked, and a page having the largest degree of image defect in the visual image was evaluated based on the following evaluation criteria. In this evaluation, Ranks 3 to 7 are acceptable levels.

Evaluation Criteria

Rank 7: In both image portions and non-image portions, there are not image transfer at all.

Rank 6: Some clear sounds are generated when two adjacent printed matters are teared off, and there are small gross-increasing part(s) in fixed image portions and a little image transfer in non-image portions. However, there are no image defects and no problem for practical use.

Rank 5: Some clear sounds are generated when two adjacent printed matters are teared off, and there is some image transfer, however, there are no image defects.

Rank 4: When two superimposed printed matters are teared off, roughness of fixed images is caused on each printed matter.

Rank 3: When two adjacent printed matters are teared off, roughness and/or gloss deterioration of fixed images are caused on each printed matter.

Rank 2: Because the superimposed printed matters are adhered to each other, there are image defects, such as white omission, at some places on image portions. The surface of the non-image portions sometimes sticks to the image portions.

Rank 1: Because the superimposed printed matters are adhered to each other, there are severe image defects such as peeling off of the surface layer of paper when the printed matters are forced to be separated from each other.

What is claimed is:

1. An electrostatic latent image developing toner comprising toner base particles and particles containing a fatty acid metal salt, wherein the toner base particles contain a crystalline resin comprising a segment of a first resin and a segment of a second resin chemically bonded to each other and an amorphous resin containing at least the second resin;

the crystalline resin is a hybrid crystalline polyester resin;

the first resin is a crystalline polyester resin;

the second resin is an amorphous resin; and the volume-based median diameter (Da) of the toner base particles and the volume-based median diameter (Db) of the particles containing the fatty acid metal salt satisfy the relations represented by Expressions (1) and (2) below:

$$0.5\ \mu m \leq Db \leq 2.0\ \mu m \quad \text{Expression (1)}$$

$$0.1\ Db/Da \leq 0.5. \quad \text{Expression (2)}$$

2. The electrostatic latent image developing toner according to claim 1, wherein a content of the segment of the second resin is in a range of 0.1% to 30% by mass based on an amount of the hybrid crystalline polyester resin.

3. The electrostatic latent image developing toner according to claim 1, wherein a content of the hybrid crystalline polyester resin is in a range of 5% to 30% by mass based on an amount of the toner base particles.

4. The electrostatic latent image developing toner according to claim 1, wherein the second resin is a vinyl resin.

5. The electrostatic latent image developing toner according to claim 1, wherein the volume-based median diameter

TABLE 3

| TONER No. | MEDIAN DIAMETER OF TONER BASE PARTICLES (Da) [μm] | CRYSTALLINE RESIN No. | CRYSTALLINE RESIN CONTENT [% BY MASS] | PARTICLES CONTAINING FATTY ACID METAL SALT No. | PARTICLES CONTAINING FATTY ACID METAL SALT CONTENT [% BY MASS] | Db/Da | DOCUMENT OFFSET RESISTANCE | REMARKS |
|---|---|---|---|---|---|---|---|---|
| 1 | 6.0 | C1 | 15 | D1 | 0.30 | 0.16 | 7 | EXAMPLE |
| 2 | 6.1 | C2 | 15 | D1 | 0.15 | 0.16 | 6 | EXAMPLE |
| 3 | 5.9 | C2 | 30 | D1 | 0.05 | 0.16 | 5 | EXAMPLE |
| 4 | 7.8 | C1 | 20 | D1 | 0.30 | 0.12 | 5 | EXAMPLE |
| 5 | 4.5 | C1 | 20 | D1 | 0.10 | 0.22 | 6 | EXAMPLE |
| 6 | 6.5 | C3 | 15 | D2 | 2.00 | 0.30 | 3 | EXAMPLE |
| 7 | 6.2 | C4 | 15 | D2 | 1.00 | 0.31 | 7 | EXAMPLE |
| 8 | 5.5 | C5 | 15 | D2 | 1.00 | 0.35 | 4 | EXAMPLE |
| 9 | 5.9 | C1 | 5 | D3 | 0.60 | 0.10 | 4 | EXAMPLE |
| 10 | 6.2 | C3 | 2 | D3 | 0.60 | 0.10 | 3 | EXAMPLE |
| 11 | 5.8 | C2 | 35 | D3 | 0.60 | 0.10 | 3 | EXAMPLE |
| 12 | 6.2 | C7 | 20 | D1 | 0.30 | 0.15 | 3 | EXAMPLE |
| 13 | 8.7 | C2 | 20 | D5 | 0.30 | 0.15 | 4 | EXAMPLE |
| 14 | 3.6 | C2 | 20 | D5 | 0.30 | 0.36 | 4 | EXAMPLE |
| 15 | 6.2 | C3 | 5 | D3 | 0.60 | 0.10 | 4 | EXAMPLE |
| 16 | 5.8 | C2 | 30 | D3 | 0.60 | 0.10 | 4 | EXAMPLE |
| 17 | 6.2 | C5 | 20 | D1 | 0.30 | 0.16 | 4 | EXAMPLE |
| 18 | 6.5 | C5 | 15 | D4 | 0.30 | 2.20 | 1 | COMPARATIVE EXAMPLE |
| 19 | 6.1 | C2 | 15 | D6 | 0.30 | 0.91 | 2 | COMPARATIVE EXAMPLE |
| 20 | 6.3 | C5 | 15 | — | — | — | 1 | COMPARATIVE EXAMPLE |
| 21 | 7.0 | C6 | 15 | D2 | 1.00 | 0.28 | 1 | COMPARATIVE EXAMPLE |

(Da) of the toner base particles satisfies the relation represented by Expression (3) below:

$$3.5\ \mu m \leq Da \leq 9.0\ \mu m. \qquad \text{Expression (3)}$$

* * * * *